US005865718A

United States Patent [19]

Chan

[11] Patent Number: 5,865,718

[45] Date of Patent: Feb. 2, 1999

[54] SYSTEM AND METHOD OF OPERATING A CENTRIFUGE UTILIZING A PROTOCOL RECORD DATABASE

[75] Inventor: Wan S. Chan, Los Altos Hills, Calif.

[73] Assignee: Beckman Instruments, Inc., Fullerton, Calif.

[21] Appl. No.: 788,410

[22] Filed: Jan. 27, 1997

[51] Int. Cl.[6] ..... B04B 13/00

[52] U.S. Cl. ..... 494/10; 494/37; 364/528.08

[58] Field of Search ..... 494/1, 7, 10, 11, 494/16, 20, 37, 85; 210/739, 767, 781, 782, 787, 85, 143, 138, 360.1; 364/502, 528.08

[56] References Cited

U.S. PATENT DOCUMENTS

| | | | |
|---|---|---|---|
| 3,480,207 | 11/1969 | Strohmaier | 494/10 |
| 4,244,513 | 1/1981 | Fayer et al. | 494/11 X |
| 4,927,545 | 5/1990 | Roginski | 494/10 X |
| 4,941,868 | 7/1990 | Chulay et al. | 494/37 |
| 5,171,206 | 12/1992 | Marque | 494/37 |
| 5,287,265 | 2/1994 | Hall et al. . | |
| 5,370,599 | 12/1994 | Margue et al. | 494/10 X |

*Primary Examiner*—Charles E. Cooley
*Attorney, Agent, or Firm*—William H. May; P. R. Harder; Thomas Schneck

[57] ABSTRACT

A protocol record database is used in conjunction with operating a centrifuge device. Each protocol record includes information relevant to the centrifugation of a certain specimen. The user can search the database for a protocol on the basis of the specimen and/or the type of separation desired. The database has an interface to one or more centrifuges via a controller. The controller, operates a centrifuge in accordance with the run program of a selected protocol record. In a preferred embodiment, the protocol records have links to additional files which supplement the information contained in the protocol records. These supplemental files include information related to the availability and compatibility of the various hardware needed to perform a centrifugation. The supplemental files can also be used to provide general information to assist the user in setting up a centrifuge for an experiment.

19 Claims, 5 Drawing Sheets

SYSTEM AND METHOD OF OPERATING A CENTRIFUGE UTILIZING A PROTOCOL RECORD DATABASE

TECHNICAL FIELD

The present invention generally relates to centrifuges, and more specifically to a system and method of operating centrifuges.

BACKGROUND OF THE INVENTION

A centrifuge, quite simply, operates by spinning a rotor containing a sample at a certain speed for a certain amount of time at a given temperature. Ascertaining the run program, namely speed, time and temperature, appropriate for the sample, however, is not so simple. Complicating the matter is a variety of factors such as density of the specimen, the gradient used, the type of separation desired, the sample volume, and so on. Moreover, the availability of numerous centrifuge systems requires the additional consideration of the capabilities of the particular centrifuge device, the type of rotor and the tube and adapters being used.

Present centrifuge systems require the user to determine the run parameters, or the run program, for a particular centrifugation experiment of a sample of interest. Typically, this involves conducting a tedious and time consuming search of the literature to find a protocol for the same experimental conditions. Many thousands of protocols have been defined for a multitude of centrifugation experiments, and many more continue to be developed. Oftentimes, the user will find a centrifugation protocol that is similar to the desired experiment but otherwise inadequate for the specific task. A series of trial centrifugation runs must then be performed to obtain protocol parameters that are appropriate for the desired experiment.

Advances in centrifuge systems typically have been directed toward improving the performance of the hardware, such as: providing rotor designs which can withstand the extreme stresses of high speed centrifugation; sophisticated temperature controlled rotor chambers; and lightweight tube and adapter designs, allowing higher centrifugation speeds. Other advances are directed to minimizing the centrifugation time. For example, U.S. Pat. Nos. 4,941,868 and 5,171,206, which are assigned to the assignee of the present invention, disclose methods for minimizing centrifugation time. The '868 patent uses a dynamic simulation of gradient salt sedimentation to predict the elapsed time at which the precipitation threshold is reached for various speed settings. Knowledge of these predicted elapsed times allows the centrifuge to be operated at maximum speed thus decreasing centrifugation time, while at the same time avoiding precipitation of the gradient salt. The '206 patent decreases centrifugation time by continuously adjusting the rotor speed to maintain a maximum rotor speed. In U.S. Pat. No. 5,287,265 assigned to E.I. duPont de Nemours, an input device facilitates the entering of rotor speeds settings, addressing the inconvenience caused by the fact that rotor speed settings can range from two to six digits.

Despite these advances in centrifuge systems, it is still the task of the researcher to search for the correct protocol and to determine the proper run program in order to perform the actual experiments. A centrifuge, however, is one of number of tools which the researcher uses in solving the problem at hand, and so should be easy to use. Computing the operational run program for a centrifuge run and adjusting the centrifuge for the actual experiment generally do not relate to the problem being addressed. The researcher is burdened with unnecessary detail which tends to be distracting and therefore inefficient.

What is needed is a system and a method of operating which allows the researcher to interact with the centrifugation protocol from the point of view of the sample on which the centrifugation is to be performed, and not with respect to specific speed settings and rotor selections. A system and method of operating also is needed to facilitate the management both of the many known centrifugation protocols and of newly developed protocols.

SUMMARY OF THE INVENTION

The present invention includes a centrifuge device and a data store of centrifugation protocols. A protocol contains all the information relevant to a centrifugation run, including the physical parameters of the specimen, the separation method, the characteristics of the centrifuge and related hardware, and the run program. The protocol may include audio and/or video files used to explain the use of the hardware components of the centrifuge, to record personal observations about the protocol, and so on. In a preferred embodiment, the protocol records are stored in a database for access by the user. Commercially available database systems may be used.

A database interface allows the user to search for a desired protocol, to select a protocol and to initiate a centrifugation run using the selected protocol. A user interface allows the user to search through the database for a desired protocol. Moreover, the user interface allows the user to define a protocol, either from scratch or by modifying existing protocols.

A controller means provides a data link between the protocol database and the centrifuge device. The controller means accesses the database to obtain the run program from the selected protocol record. The run program is then used to operate the centrifuge device. Thus, the protocol database allows the researcher to focus on the research at hand without having to consider the details of the specific hardware being used.

The preferred embodiment also includes access to both a local area network (LAN) and access to a wide area network (WAN). Thus, two or more personal computers (PCs) can share a single protocol database over the LAN. The database may reside on one PC, on a separate PC acting as a file server, or on multiple PCs as a distributed database. Access to a WAN such as the Internet allows for a remote database that can act as a central library for all known protocols. Such a database would relieve the burden of having to support and maintain a separate protocol database at a local site, or serve as a supplement to a locally maintained protocol database. In another embodiment, the controller means is accessible over the LAN by two or more PCs and is capable of controlling two or more centrifuge systems.

BEST MODE OF CARRYING OUT THE INVENTION

Figure 1:
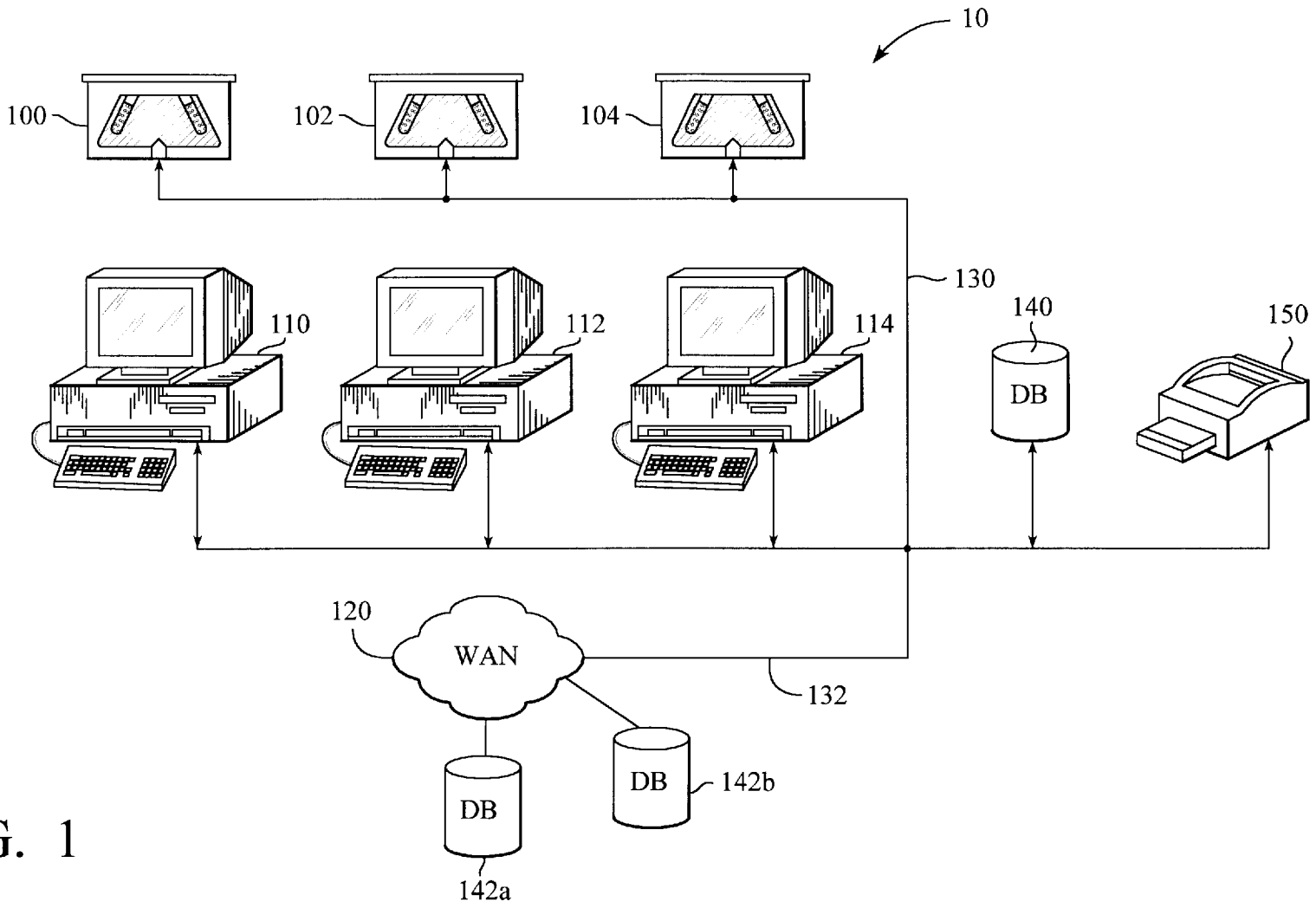
FIG. 1 shows a system diagram of the components of the present invention.

As shown in FIG. 1, the present invention includes a centrifuge 100 coupled to a PC 110 over a data line 130. In one configuration, the data line 130 may simply be an RS-232 cable connecting a serial port of the PC 110 to a serial interface on the centrifuge 100. It is noted that the invention will work equally well using other connection standards, such as the instrumentation interface standard known as GPIB.

The PC 110 may be also be configured to communicate with two or more centrifuge devices 100–104. Alternatively, two or more PCs 110–114 may be configured to have access to the centrifuge devices. In general, it is contemplated that any number of PCs and centrifuge devices may be connected in a networked arrangement so that any PC may communicate with and control any centrifuge. In such applications, the data line 130 may be the backbone of a local area network, such as Ethernet, 10Base-T, a token ring, etc. Depending upon the type of backbone being used, the PCs and centrifuge devices will be equipped with the necessary hardware to enable communication among the devices. Such hardware is considered to be well within the scope of the person of ordinary skill in the relevant arts.

In one embodiment of the invention, the protocol database is contained within a single PC. The embodiment depicted in FIG. 1 shows a protocol database 140 being accessed over the network. In this case, the database 140 is a file server, which allows access to the database for each of the PCs 110–114. Also shown in FIG. 1 is a printer 150 that is accessible over the network.

FIG. 1 further shows a wide area network (WAN) 120 which can be accessed over a communication line 132. Remote databases 142*a*, 142*b* (as compared to local database 140) are accessed over the WAN. For example, the communication line 132 may be an information services data network (ISDN) line and the databases 142*a*, 142*b* may be web pages on the world wide web. Alternatively, the database may be loaded on remote computers which are accessed over a telephone line and which use the TELNET and FTP communication protocols to search and download centrifugation protocols. A remote database can be used a central library of known protocols developed by researches anywhere. Conversely, researchers may dial in or otherwise gain access to the centralized database to search and download protocols for their own use.

Figure 2A:
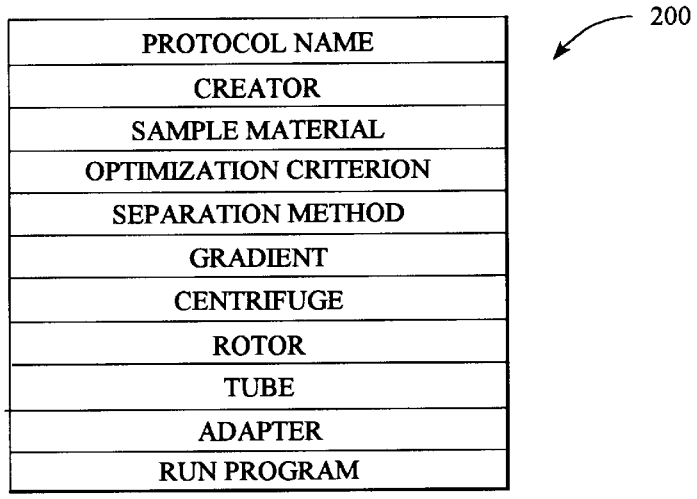
FIGS. 2A and 2B illustrate a protocol record in accordance with the present invention.
Figure 2B:
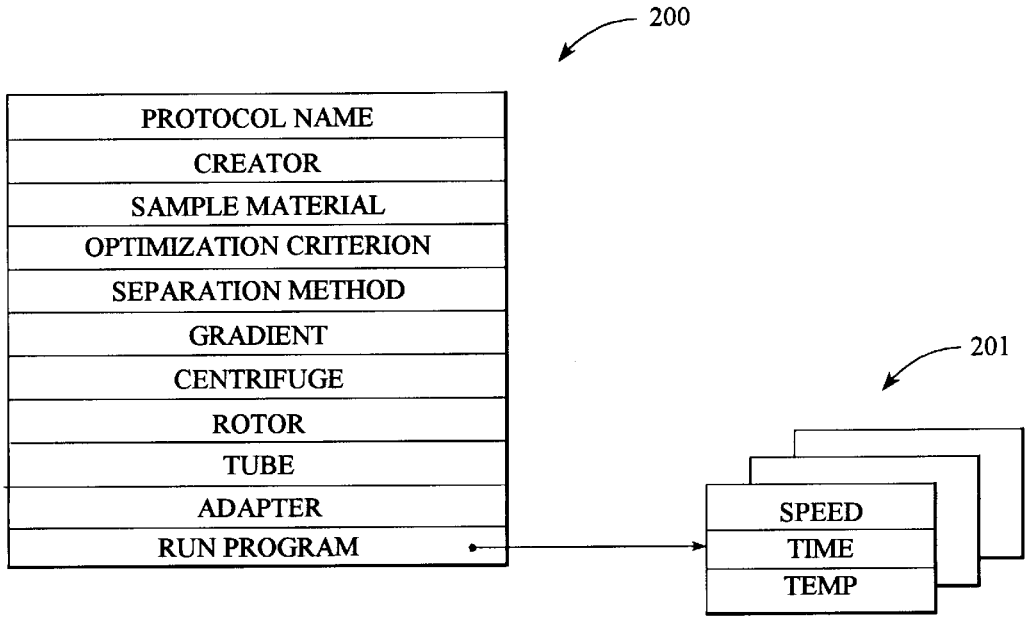

FIGS. 2A and 2B show the typical fields of a protocol record 200 in accordance with the present invention. The PROTOCOL NAME identifies the protocol record. The CREATOR identifies the person or persons who developed the protocol. The SAMPLE MATERIAL field identifies the biochemical specimens being separated. The OPTIMIZATION CRITERION relates to the quality of the separation that will be attained. For certain experiments where a sufficiently large volume of sample is available, a short spin time resulting in a separation with broad separation boundaries may be acceptable if most of the constituent of interest is sufficiently separated. On the other hand, if only a small amount of the sample is available, a long spin time may be needed to attain a satisfactory separation. The OPTIMIZATION CRITERION field, therefore, provides a rough indication of the spin time of the sample. The SEPARATION METHOD and GRADIENT fields specify the type of separation that will be performed. Typical separation methods include, but are not limited to, rate-zonal, isopycnic and pelleting protocols. Certain separation protocols, such as isopycnic separation, require a density gradient solution. In those cases, the GRADIENT field of the protocol record specifies the type of gradient solution used.

The CENTRIFUGE, ROTOR, TUBE and ADAPTER fields specify the hardware configuration for the centrifugation experiment specified in the protocol record. The CENTRIFUGE field may contain an identification subfield, in addition to specifying the type/model of centrifuge. The identification subfield is used when the system is configured to have more than one centrifuge, and serves to uniquely identify a specific centrifuge device.

The RUN PROGRAM specifies the speed and duration of the centrifugation experiment. The RUN PROGRAM also specifies the temperature setting of the rotor chamber. In certain applications, the centrifugation of a sample may proceed through numerous speed and temperature settings during the course of the centrifugation. FIG. 2B illustrates the addition of run program steps 201 as an extension of the basic protocol record 200. As can be seen in FIG. 2B, a link from the RUN PROGRAM field identifies a set of run program steps 201, which in turn specify a plurality of speed, duration and temperature settings for the separation defined by the protocol record.

Figure 3:
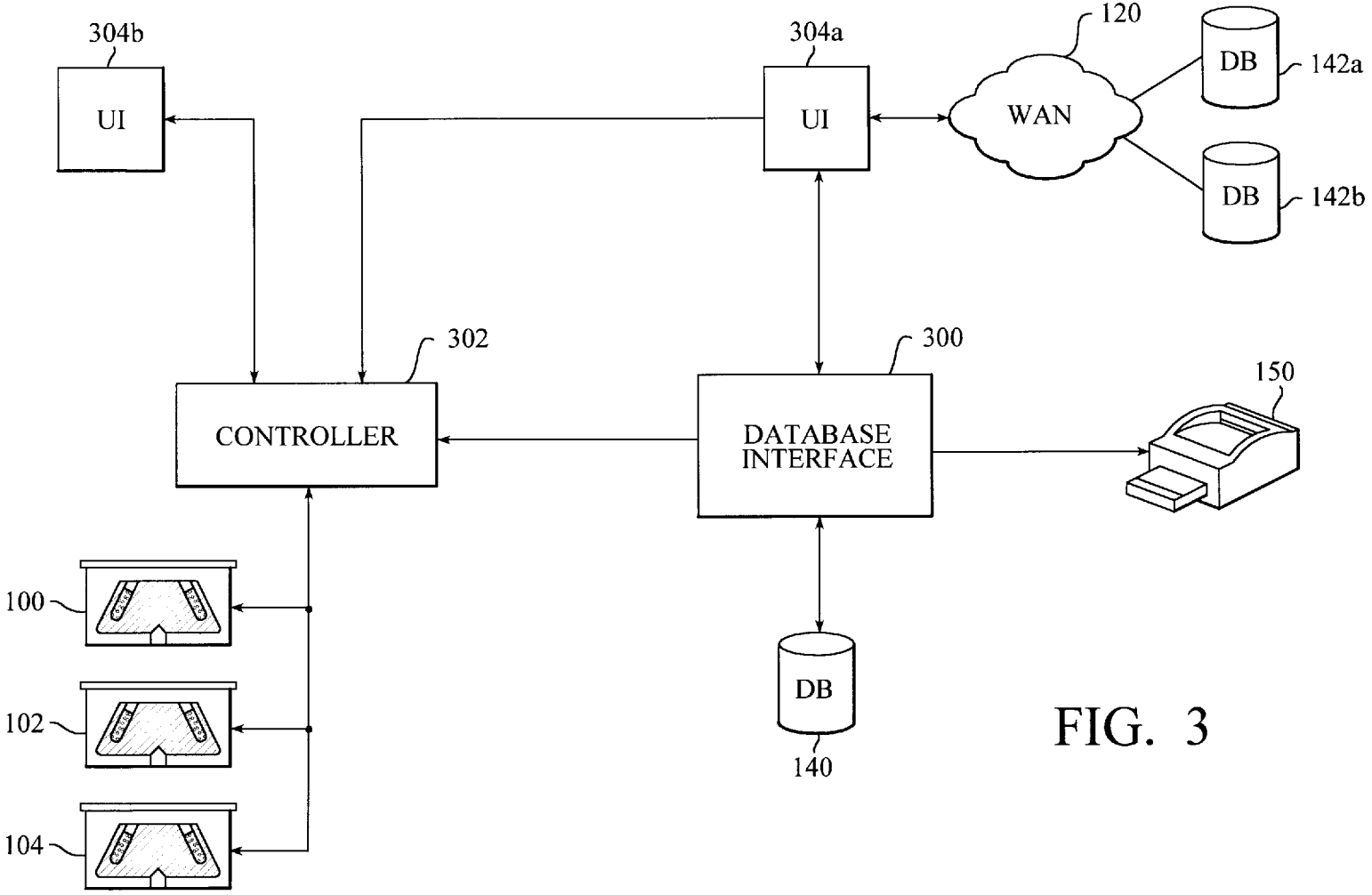
FIG. 3 is a block diagram of the software components of the invention.

The software components of the present invention are explained with respect to the block diagram of FIG. 3. A database interface 300 provides the utilities for accessing the protocol database 140, such as record locking to ensure data integrity, search capability to locate a protocol record, and creation, modification and deletion of protocol records.

A controller 302 provides control and monitoring access to a centrifuge 100–104. The controller 302 also has access to the database 140 in order to retrieve the run program steps 201 (FIG. 2) for a selected protocol, which the controller then sends to the centrifuge. The controller is also capable of retrieving status information from the centrifuge 100–104, if such information is available. For example, current rotor speed and temperature readings may be available from the centrifuge. In such a case, the controller 302 periodically polls the centrifuge for the information.

The controller 302 can communicate with a centrifuge through any one of a number of channels, including conventional serial or parallel ports, and instrumentation specific bus architectures. The particular form of communication channel is not critical. Thus, a radio link, an infra-red link, or other wireless channel would work equally well. The particular kind of communication channel used is largely a function of the interfacing capability of the centrifuge device. The controller 302 shown in FIG. 3 is configured to operate more than one centrifuge, although it is possible to configure a controller for each centrifuge.

A user interface 304*a*, 304*b* provides user access to the system. In one instance, a user interface 304*a* provides access to the protocol record database 140 via the database interface 300. The user interface 304*a* typically allows the user to create, modify and delete protocol records. In addition, the user interface allows the user to search individual fields of the protocol record. Where the database 140 is one of the commercially available databases, the user interface 304*a* is likely to be implemented using user interface tools provided by the database. However, this is not necessarily the case. Other user interfaces capable of accessing the database will work equally well. For example, the user interface may be an expert system. This would be advantageous in that the expert system can lead the user through a series of questions and suggestions to facilitate defining a protocol record and to locate protocol records appropriate to the user's needs. Additional features for the user interface include consistency checking; for example, the user interface may confirm that the selected hardware is compatible with the separation method.

The user interface 304*a*, 304*b* is in communication with the controller 302. The controller obtains from the user interface either a reference to the protocol record, namely the PROTOCOL NAME (FIG. 2), or a list of run program steps 201 corresponding to a selected protocol record. Conversely, the controller may send back status information obtained from the centrifuge to the user interface to be conveyed to the user. The userinterface 304*a* may also include access to the wide area network 120, in order to access a remote protocol record database 142*a*, 142*b*.

Although the user interfaces 304*a*, 304*b* in FIG. 3 are represented by a block, this is not intended to imply that the user interface necessarily consists of a single software module. It is possible that a number of independent programs comprise the "user interface." For example, a database-specific user interface may be employed for database access and network access software such as a terminal communications package or a web browser may be used to access the network.

The software components shown in FIG. 3 can be implemented to execute within a single workstation. Thus, a user interface 304*a*, the database 140, 300 and the controller 302 would reside in a single PC; either as a single process or as independently executing processes, depending upon the capabilities of the operating system (OS) running on the PC. On the other hand, the software components may be fully distributed amongst a number of PCs on a local area network (see FIG. 1). For example, the database 140, 300 may reside on a file server, which is networked to workstations running the user interfaces 304*a*, 304*b*. Similarly, the controller 302 may be co-resident with the file server or execute on a separate machine. Other configurations are well within the capability of a person of ordinary skill in the art and will work equally well. The specific configuration is not critical to the operation of the present invention, but rather is more a function of the capability of the OS.

Figure 4:
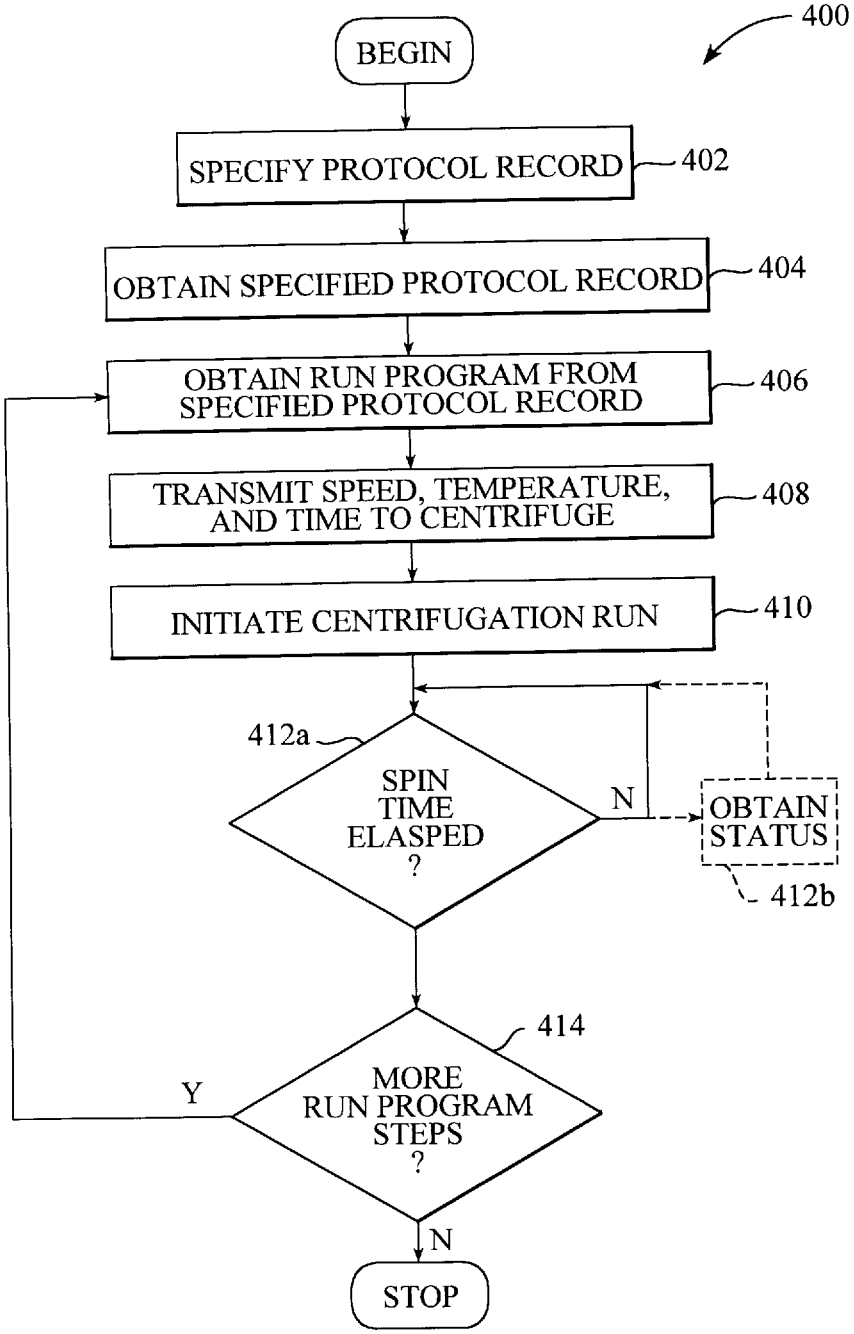
FIG. 4 is a flowchart of the sequence of events for operating a centrifuge in accordance with the present invention.

The typical operation of the present invention will now be discussed with reference to the flowchart 400 shown in FIG. 4. First, a user having access to a protocol record database 140, 142*a*, 142*b* via a user interface specifies a protocol record, step 402. The selection of a protocol record can be keyed on any of the fields of the protocol record shown in FIG. 2A. Thus a user may search for an isopycnic separation of DNA. The search criteria would consist of "SAMPLE MATERIAL=DNA" & "SEPARATION METHOD=ISOPYCNIC." The search may be narrowed by further specifying "GRADIENT=SUCROSE." In general, any field or combination of fields can be searched in an attempt to locate a particular protocol.

Having selected a protocol record, the user then communicates the protocol record to the controller 302. The controller then accesses the database 140 to obtain the specified protocol record, step 404. The corresponding run program steps 201 are then accessed by the controller, step 406. Alternatively, steps 404 and 406 may be effectively combined if the run-time records can be accessed without the controller first accessing the specified protocol record. Yet another alternative, is for the user interface 304*a*, 304*b* to retrieve the run-time records and communicate them to the controller 302.

Depending on the protocol, one or more run program steps 201 may be needed to completely specify a centrifugation run. The controller 302 obtains each run program step and communicates the speed, time and temperature settings to the centrifuge device, step 408. The centrifuge device is then initiated to perform a run in accordance with the specified settings, step 410. The controller then pauses until the specified duration of time has elapsed, step 412*a*, at which point the next run program step is retrieved, steps 414 and 406. When all of the run program steps have been processed, the centrifugation is complete.

The controller 302 is also capable of polling the centrifuge for its current operating status, assuming the centrifuge also is equipped with the capability. It may be useful to know the current speed and temperature of the centrifuge near the beginning and end of each program step of a centrifugation run. It also may be useful to have a monitor of the current conditions to ensure that the centrifuge is operating properly. FIG. 4 shows in phantom a polling step 412*b* in which the controller polls the centrifuge for it current operating status. This information may be communicated to the user interface for display to the user, or may be stored in a file. Depending on the capabilities of the centrifuge device, the polling step 412*b* might not be performed.

Figure 5:
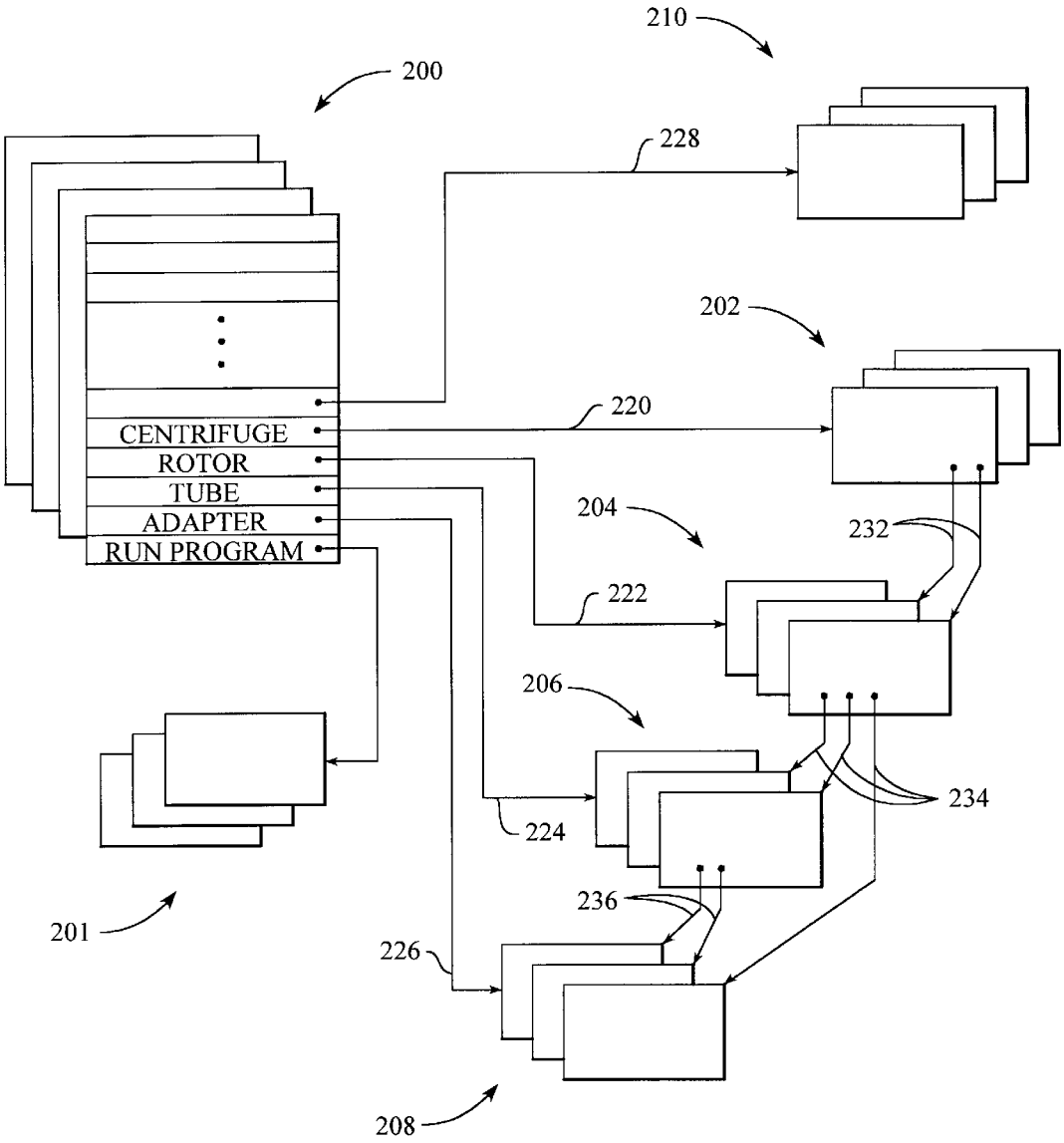
FIG. 5 shows additional files which supplement a protocol record.

The preferred embodiment of the present invention includes additional information to supplement some of the fields of the protocol record shown in FIG. 2A. FIG. 5 shows a plurality of protocol records 200. For each of the protocol records, the CENTRIFUGE, ROTOR, TUBE and ADAPTER fields have respective links to other files containing information specific to the particular hardware used for the protocol. For example, the CENTRIFUGE field includes a link 220 to one of a plurality of centrifuge files 202 which contains information specific to a particular centrifuge. The ROTOR field has a link 222 to one of a plurality of rotor files 204. The TUBE field has a link 224 to one of a plurality of tube files 206, and the ADAPTER field is linked via link 226 to one of a plurality of adapter files 208.

These supplemental files 202–208 may consist of any combination of text and audio-visual files. They provide information explaining the usage of the particular hardware. The centrifuge files 202, for example, may include video and sound clips explaining the operation of the device, special features of the device, how to load the specimens into the device and so on. The tube and adapter files 206, 208 may contain images of the hardware for identification purposes, and information on loading the hardware into a centrifuge.

Certain of the supplemental files 202–208 may include links to other of the supplemental files. For example, each centrifuge file 202 may include one or more links 232 to the rotor files 204, identifying those rotors which may be used with a particular centrifuge. Similarly, each rotor file 204 may have links 234 to tube files 206 and/or adapter files 208 to indicate which tubes and adapters may be used with a given rotor. Finally, the tube files have links 236 to the adapter files. These files are especially useful during the definition phase of a protocol record. The supplemental files 202–208 allow the user interface to provide information to the user as to the availability and compatibility of the hardware, thus eliminating any guess work by the user. During the setup of an experiment, the files can show the user how to set up the hardware for a run.

FIG. 5 shows an additional set of files 210 which are accessible from the protocol record via a link 228. These files are general help files, and include information about the use of the system. In fact, every field in the protocol record can be associated with one or more supplemental files to provide textual, and audio/visual information to assist the setting up of a centrifuge for an experiment.

I claim:

1. A centrifuge system comprising:

a centrifuge device;

a data store for storing centrifugation protocols;

means for creating said centrifugation protocols and for storing said centrifugation protocols onto said data store;

display means for showing available protocols and for selecting one of said centrifugation protocols from said data store; and controller means for operating said centrifuge device, including means for accessing said data store to obtain one of said centrifugation protocols and means for communicating a selected one of said centrifugation protocols to said centrifuge device;

whereby said centrifuge device is operated by said controller means in accordance with said selected one of said centrifugation protocols.

2. The centrifuge system of claim 1 wherein each of said centrifugation protocols is associated with a biochemical specimen, and said each centrifugation protocol includes a sample field which identifies said biochemical specimen, a first plurality of data fields which specify physical parameters of said biochemical specimen, a second plurality of data fields which identify hardware used to centrifuge said biochemical specimen and a third plurality of data fields which specify a run program for centrifugation of said biochemical specimen.

3. The centrifuge system of claim 2 wherein said display means includes means for specifying a biochemical specimen and physical parameters of said biochemical specimen, said display means further including search means for finding, in response to said means for specifying, a matching centrifugation protocol in said data store.

4. The centrifuge system of claim 1 further including a second data store having multimedia files and means for presenting said multimedia files to a user, said multimedia files containing information related to said centrifuge device and information related to hardware for use with said centrifuge device, each of said centrifugation protocols having one or more links to said multimedia files.

5. The centrifuge system of claim 1 further including at least a second centrifuge device, and said controller means further including means for selectively communicating with said centrifuge device and said second centrifuge device.

6. The centrifuge system of claim 1 further including means for communicating over a wide area network to access a remote data store, means for downloading additional centrifugation protocols stored in said remote data store and means for storing downloaded copies of said additional centrifugation protocols into said data store.

7. A method for centrifuging biochemical specimens comprising the steps of:

creating a database of protocol records, each protocol record having a first identifier which identifies a biochemical specimen, a second identifier which specifies a separation method, first parameters which specify physical attributes of said biochemical specimen, second parameters which specify hardware used to centrifuge said biochemical specimen and third parameters which specify a run program for centrifuging said biochemical specimen;

storing a plurality of said protocol records, including querying a user for information relating to a new protocol record, ensuring internal consistency of information provided by said user and recording said information as one of said protocol records in said database;

identifying a protocol record from among said plurality of protocol records; and operating a centrifuge in accordance with said identified protocol record, including accessing said database to retrieve said run program associated with said identified protocol record and communicating said run program to said centrifuge.

8. The method of claim 7 wherein said step of storing further includes communicating over a wide area network, gaining access to a remote database and downloading an additional protocol record from said remote database.

9. The method of claim 7 wherein said step of storing further includes selecting audio-visual files related to hardware associated with a protocol record and linking selected audio-visual files to said protocol records.

10. The method of claim 9 wherein said step of identifying a protocol record includes displaying audio-visual information related to hardware used to centrifuge said specified biochemical specimen.

11. The method of claim 7 wherein said step of identifying a protocol record includes specifying a biochemical specimen and a separation method.

12. The method of claim 11 wherein said step of identifying a protocol record further includes specifying one or more physical attributes of said biochemical specimen.

13. The method of claim 7 wherein said step of operating a centrifuge further includes selecting between at least a first and a second centrifuge.

14. A system for centrifugation of samples, said system comprising:

a plurality of centrifuge devices;

a database of protocol records, each protocol record having fields which identify a sample, physical parameters of said sample, a centrifuge for centrifugation of said sample, hardware to be used with said centrifuge, centrifugation criteria and a run program for centrifugation of said sample;

a database of multimedia files, said multimedia files having information relating to said centrifuge devices and hardware for use with said centrifuge devices;

means for creating a new protocol record and for storing said new protocol record in said database of protocol records, including means for linking at least one of said multimedia files to said new protocol record;

means for selecting one of said protocol records, including means for identifying a sample and physical parameters of said identified sample and means for examining said multimedia files; and means for controlling said centrifuge devices, including means for accessing said database of protocol records to obtain a run program of a selected protocol record and means for selectively communicating with one of said centrifuge devices, whereby a corresponding centrifuge device identified by said selected protocol record is controlled in accordance with a corresponding run program identified by said selected protocol record.

15. The system of claim 14 wherein said database of protocol records, said means for creating, said means for selecting and said means for controlling are computer programs executing on a computer.

16. The system of claim 14 further including a first computer having said database of protocol records, a second computer having said means for selecting and said means for controlling, said first and second computers having a communication link therebetween.

17. The system of claim 16 further including a third computer having said means for selecting and said means for controlling, said first and third computers having a communication link therebetween.

18. The system of claim 14 further including means for communicating over the Internet, means for obtaining protocol records from remote sites on the Internet and means for storing said obtained protocol records in said database of protocol records.

19. The system of claim 14 wherein said hardware includes rotors, centrifuge tubes and adapters.

* * * * *